United States Patent [19]

Jung

[11] 4,216,713

[45] Aug. 12, 1980

[54] CAN CRUSHING MECHANISM

[76] Inventor: William E. Jung, P.O. Box 16984, Orlando, Fla. 32811

[21] Appl. No.: 23,586

[22] Filed: Mar. 26, 1979

[51] Int. Cl.[3] ..... B30B 1/06; B30B 9/32

[52] U.S. Cl. ..... 100/209; 100/DIG. 2; 100/91; 100/216; 100/218; 100/266; 100/292; 100/295; 209/567

[58] Field of Search ..... 100/DIG. 2, 209, 266, 100/218, 295, 216, 91, 292; 209/567

[56] References Cited

U.S. PATENT DOCUMENTS

| | | | |
|---|---|---|---|
| 2,045,769 | 6/1936 | Geffcken | 209/567 |
| 2,619,150 | 11/1952 | Smith | 100/DIG. 2 |
| 2,800,159 | 7/1957 | Walsh | 100/DIG. 2 |
| 3,034,422 | 5/1962 | Mcc. Howell | 100/DIG. 2 |
| 3,048,096 | 8/1962 | Guedel | 100/DIG. 2 |
| 3,374,730 | 3/1968 | Cain | 100/218 X |
| 3,557,600 | 1/1971 | Saito | 100/292 |
| 3,659,520 | 5/1972 | Garrett | 100/216 |
| 3,687,062 | 8/1972 | Frank | 100/DIG. 2 |
| 3,772,985 | 11/1973 | Girten | 100/218 X |
| 3,817,169 | 6/1974 | Bischoff | 100/DIG. 2 |
| 3,916,780 | 11/1975 | Heiser | 100/216 X |
| 4,062,283 | 12/1977 | Kaminski | 100/218 |
| 4,091,725 | 5/1978 | Arp | 100/DIG. 2 |
| 4,120,240 | 10/1978 | Smith | 100/DIG. 2 |

FOREIGN PATENT DOCUMENTS

| | | | |
|---|---|---|---|
| 2724886 | 3/1978 | Fed. Rep. of Germany | 100/209 |

*Primary Examiner*—Billy J. Wilhite

*Attorney, Agent, or Firm*—Duckworth, Hobby, Allen & Pettis

[57] ABSTRACT

An apparatus for crushing cans uses a pair of guide rods having an anvil attached at each end, and a pair of sliding rams sliding on the guide rods. Can support wire members are positioned between each ram and anvil to support a can during crushing. A ram drive cam alternately drives each ram to crush a can against its associated anvil. The single drive cam is connected through reduction gearing to a flywheel which is driven by an electric motor. Each ram has a cam follower and the rams are connected together with springs to maintain the cam followers in continuous contact with the cam. A second embodiment has four rams driven by a single motor and flywheel driving a pair of cams and a can feed mechanism feeds cans in synchronization with the movement of rams.

24 Claims, 10 Drawing Figures

CAN CRUSHING MECHANISM

BACKGROUND OF THE INVENTION

The present invention relates to can crushers, and especially to a can crusher of the type that alternately crushes one can at a time being fed thereto.

In the past, a great variety of machines have been provided to shred cans or to compact cans to reduce the space the cans take up in storage and shipping for recycling. This becomes more important as the price of aluminum and the cost of energy rises, since a considerable portion of the price of producing raw aluminum from ore is in the large amount of electrical energy required. Many of the prior art machines developed for compacting cans have been too bulky or expensive for placement at retail outlets where the crushed cans can be easily stored and eventually picked up for recycling. Many prior art can crushing mechanisms crush the cans in a random fashion, so that the cans retain small amounts of liquid therein. If the aluminum cans are fed directly to melting furnaces in this manner, the liquid tends to expand and cause the cans to explode. Accordingly, it has been common for large volumes of cans to be shredded into fine pieces, but this takes large, expensive machinery, and tends to generate large amounts of fine aluminum dust and particles.

The present invention, on the other hand, is directed toward an inexpensive but fast can crusher which compacts the can in a manner to force any liquid from the can, and which can be used at retail outlets or at central collection points for rapid processing of large volumes of cans.

One prior art U.S. Pat. No. 3,659,520 to Garritt, et al., teaches a beverage can compressor operating with a sliding ram driven by an eccentric mounted disc driving a cam follower which is spring returned. Cans in this mechanism are compressed from the side. The cans are allowed to roll into the compacting areas with each can stopping the previous can. A spring supports the can in position and is pushed out of the way during the compacting operation. The ram is driven by an electric motor through considerable reduction gearing. Another patent operating in a similar manner to the present invention is the Bishoff U.S. Pat. No. 3,817,169 for a can crusher driven by an electric motor driven eccentric which slides a ram for crushing a can between the can ends. This can crusher includes a can feeding chute for feeding the cans one at a time into a cylindrical crushing area, and requires a mechanism for lifting each can on the chute up into the semi-cylindrical area, thus, preventing the cans from interfering with each other during the compacting operation. In contrast to these prior two patents, the present invention is directed toward a more rapid crushing of cans utilizing a single cam drive shaped to drive a pair of rams, each ram connected to each other with a spring return, and each sliding on a single pair of guides, which also have the anvils attached to the ends thereof.

Other typical prior U.S. patents dealing with can crushers may be seen in the Smith U.S. Pat. No. 2,619,150; and in the Heiser U.S. Pat. No. 3,916,780; and in the Gurtin U.S. Pat. No. 3,772,985.

SUMMARY OF THE INVENTION

A can crushing mechanism has been provided which has a frame and a plurality of guide rods attached to the frame having an anvil attached at each end of the plurality of guide rods. A pair of sliding rams are slidably mounted on the guide rods between the ends thereof, and the cam drive is supported on a bearing mounted to the frame and located between the sliding rams. Support wires are mounted to support each can that is fed from a chute between each anvil and each sliding ram, and the cam drives the rams alternately, thereby applying the full force of the drive to only one can at a time. The rams are connected to each other with a spring so that both rams having cam followers thereon are maintained in contact with the drive cam. The drive cam is driven by a reduction gear driven by an electric motor driven flywheel. A can feed chute feeds one can at a time between each anvil and ram and is actuated by a linear cam attached to the ram which actuates a trip mechanism to release one can at a time.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
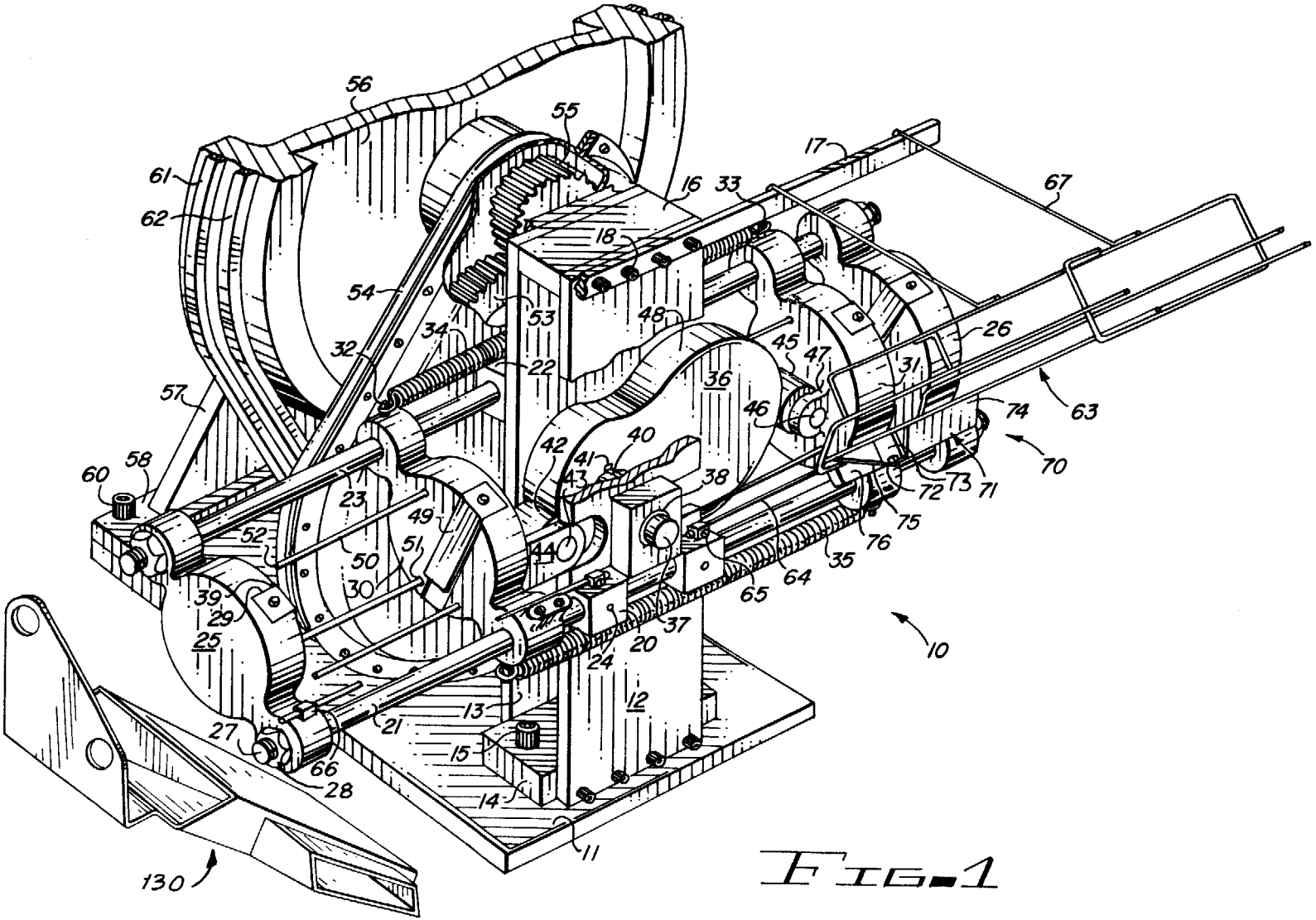
FIG. 1 is a perspective view of a can crushing mechanism in accordance with the present invention.

Referring to FIG. 1 of the drawings, a can crushing mechanism 10 is illustrated having a framework which includes a base plate 11, a pair of side plates 12 and 13, a bottom spacer 14 attached to the base plate with bolts 15 and a top spacer 16 having a can rack support member 17 bolted through the side member 12 to the top spacer 16 with nuts 18. Side member 12 has a pair of rod support blocks 20 mounted thereon supporting a guide rod 21, while side plate 13 has a pair of rod support blocks 22 supporting a guide rod 23. The rods are locked to the rod support members with locking bolts 24. The guide rods 21 and 23 have a first anvil 25 attached on one end, and a second anvil 26 attached to the opposite end thereof. The anvils are supported by the rods 21 and 23 having threaded ends 27 with retainer nuts 28 threaded thereon. A sliding ram 30 is slidably mounted to the rods 21 and 23 facing the anvil 25, while a sliding ram 31 is slidably mounted to the rods 21 and 23 facing the anvil 26. The sliding ram 30 has a pair of spring posts 32, while sliding ram 31 has a pair of spring posts 33, with springs 34 and 35 connected between the post to continuously bias the rams 30 and 31 toward each other. The rams are maintained separated by a cam 36 attached to a main shaft 37 riding in a boss-bearing 38 attached to the frame side 12. The shaft 37 has a key 40 in a key way 41. Ram 30 has a cam follower 42 riding on a shaft 43 in a yoke 44, while ram 31 has a cam follower 45 riding on a shaft 46 in a yoke 47. The cam followers 42 and 45 ride against the cam surface 48 of the cam 36 and are maintained in contact with the surface 48 by the springs 34 and 35. The shape of the cam 36 allows the cam to drive rams 30 and 31 alternately, as the cam is rotated with the shaft 37, so as to drive one ram toward its anvil for crushing a can while the other ram is being returned, and then alternately to drive the other ram and return the first ram. Cans are supported between each ram 30 and 31 and each anvil 25 and 26 by a plurality of wire supports 50 sliding through apertures 51 in ram 30 and mounted to the framework. Each wire 50 has an end 52 which does not reach the anvil 25, or 26 in the case of ram 31, so that a can can be supported by the wires 50 but allowed to drop through the opening at the end of the wires 50.

The anvil 25 has a leaf-spring 29 mounted thereto so that the front portion of the spring 29 is in a slot 39, and similarly, the ram 30 has a leaf-spring 49 mounted in a slot so that when the springs 29 and 49 are compressed by the driving of a can with the ram 30, the springs are flat in their respective slots, but following the crushing of the can, the springs 29 and 49 will pop out to push the can loose from the ram 30 or the anvil 25. A crushed can would normally fall by the force of gravity, but after a great many cans have been crushed, liquid from the cans tends to accumulate on the anvil and ram, which can result in a crushed can sticking to the anvil or ram. This problem is solved by the simple leaf-spring mounted in a slot formed the same size as the spring and anchored on top of the anvil with a screw or the like.

The main shaft 37 is supported by a boss-bearing attached to the side 13 and is attached to a reduction gear 53 located in a housing 54. Gear 53 engages a spur gear 55 which in turn is connected to a large flywheel 56. Flywheel 56 is supported by a support bracket 57 having a base 58 and anchored to the base plate 11 with bolts 60. Flywheel 56 is driven by a pair of belts 61 and 62 which in turn are driven by an electric motor. Cans are fed to a crushing mechanism by a can chute 63 which guides the cans into the crushing mechanism. The can chute is supported by the feed chute support rods 64 which are locked at one end to the locking bolt blocks 20 with a locking bracket 65 and are locked at the other end with a rod support bracket 66 mounted to the anvil 25 on one side and to the anvil 26 on the other. The can rack 63 is also supported by a pair of support arms 67 connected to the can chute support 17.

It will be clear that while one can chute 63 is illustrated there will be one can chute for each anvil and ram combination.A can feed mechanism 70 can be seen generally in this view having a trip mechanism 71 rotatably supported on a shaft 72 to a bracket 73 attached to the can chute 63. The trip mechanism 71 has a back plate 74 connected in V-fashion to a front plate 75 and is actuated by a linear cam 76 attached to a sliding ram 31, as will be explained in more detail in connection with FIGS. 3 through 6. Each sliding of the ram 31 moves the linear cam 76 to actuate the can feed mechanism 70 to drop one can into the crushing area between the ram 31 and the anvil 26.

In operation, an electric motor (not shown) drives the belts 61 and 62 to drive the flywheel 56 which drives the spur gear 55, which in turn drives the reduction gear 53. The reduction gear 53 drives the main shaft 37 to rotate the cam 36. Cam 36 is shaped to be driving either ram 30 or 31 while retracting the other. The rams 30 and 31 have their followers 42 and 45 in continuous engagement with the cam 36 by virtue of springs 34 and 35 connected between the rams. As the cam 36 rotates, the rams 30 and 31 are alternately driven in a predetermined pattern toward the anvils 25 and 26 to crush the can that has been fed therebetween. The can is supported by the support wires 50 and once crushed, will fall past the ends 52 of the support wires 50. One crushing side is being loaded while the other is crushing a can. The flywheel stores the energy so that the cam 36 can be applying a greater torque during the crushing operation, and since only one can is being crushed at a time, the force is being applied to only one can at a time, thereby reducing the power needed for the crushing operation. The flywheel 56, advantageously, allows the operation with only the two gears rather than a substantial gear box, which might otherwise be required. Since the cans are crushed between the ends and are supported only by wires, any fluids in the cans are driven out of the opening existing in the cans, so that the crushed cans are substantially free of liquids which might cause the cans to explode during the melting down of the aluminum. A discharge chute 130 is shown adjacent one discharge and described hereinafter in connection with FIGS. 7 and 8.

Figure 2:
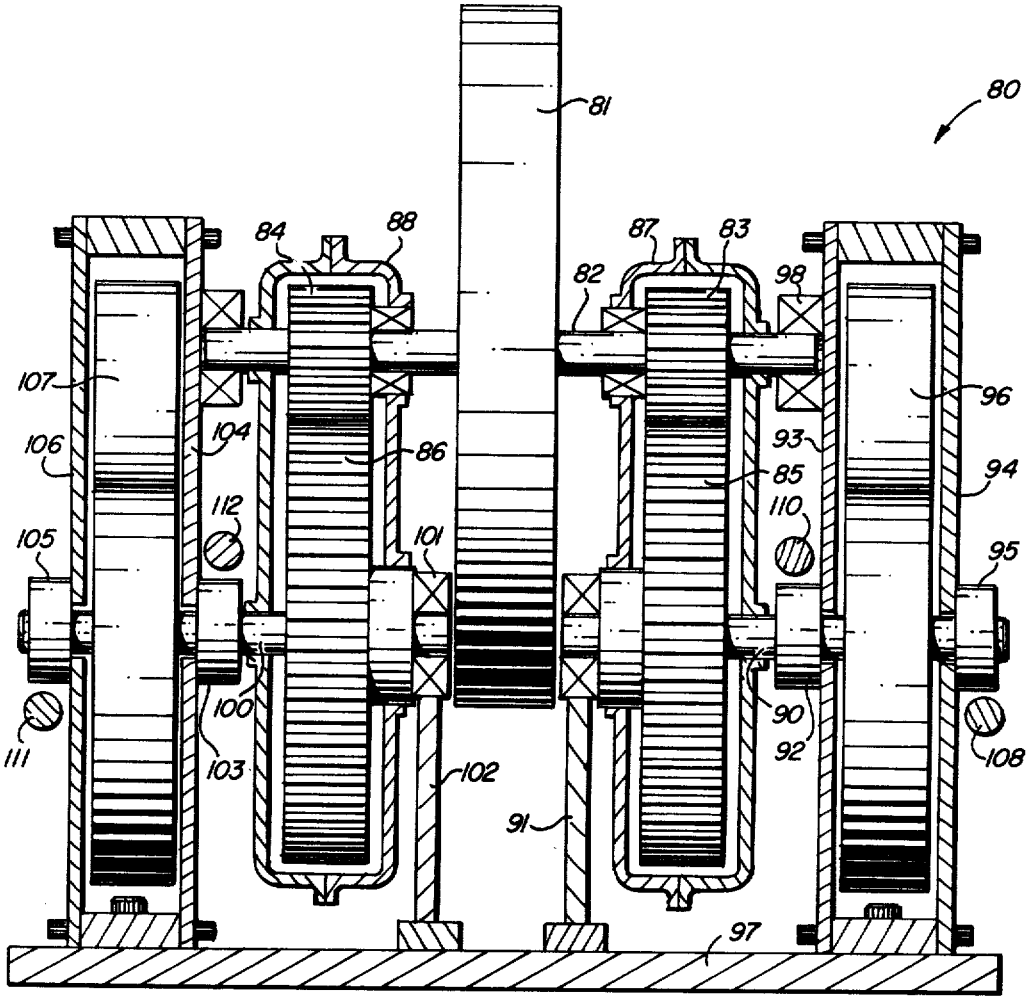
FIG. 2 is a sectional view of a second embodiment of the present invention.
Figure 9:
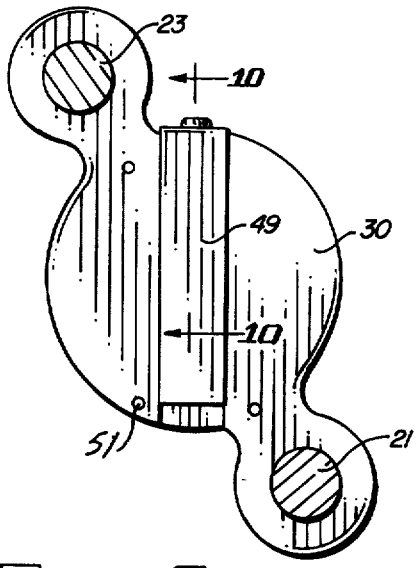
FIG. 9 is a partial sectional view of the ram and its support rods.
Figure 10:
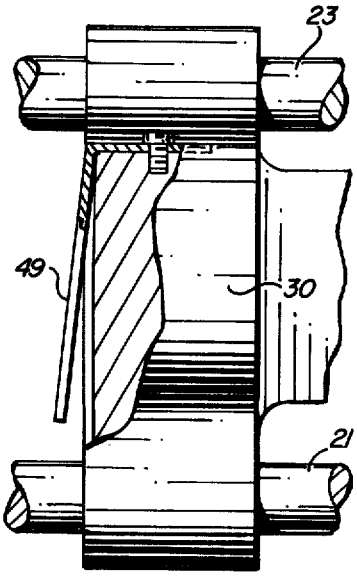
FIG. 10 is a sectional view taken on line 10—10 of FIG. 9.

Turning now to FIG. 2, an alternate embodiment of a can crushing mechanism 80 is illustrated having a single flywheel 81 driving a shaft 82 driving a spur gear 83 on one side and a spur gear 84 on the opposite side thereof. The spur gear 83 engages a reduction gear 85, while spur gear 84 engages a reduction gear 86. The gears 83 and 85 are housed in a housing 87 while the gears 84 and 86 are housed in a housing 88. Reduction gear 85 is connected to a shaft 90 supported by a support bracket 91 on one end and on a boss-bearing 92 on the other end, while the shaft extends past a side plate 93 and 94 to a boss-bearing 95, where it drives a cam 96. The bracket 91 and the side plates 93 and 94 are mounted to a common base plate 97 while the shaft 82 is supported in bearings 98 attached to the side plates 93 and 94. Similarly, the shaft 82 drives the spur gear 84 and reduction gear 86 which is rotating a shaft 100 supported in a bearing 101 supported by a support bracket 102 attached to the base 97. Shaft 100 is also attached through a boss-bearing 103 mounted on a side plate 104 and to a boss-bearing 105 mounted to a side plate 106, and has a cam 107 mounted thereto between the plates 104 and 106. A pair of guide rods 108 and 110 is mounted beside the cam 96 and a pair of guide rods 111 and 112 is mounted adjacent the cam 107. Each side of the can crushing mechanism 80 of this embodiment operates identically to the embodiment of FIG. 1, except one motor drive and one flywheel are utilized for driving four crushing mechanisms simultaneously, so that larger numbers of cans can be fed through four chutes and the cams 96 and 107 are timed so that only one can is being crushed at a time to apply full force against that can, thereby allowing four cans to be crushed in a sequence, one after the other.

Figure 3:
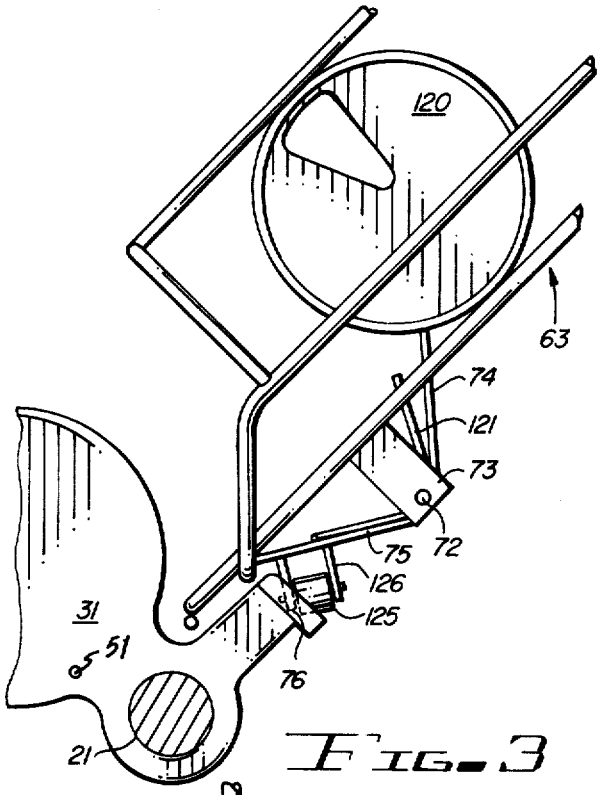
FIG. 3 is a fragmentary end elevation of the can feed mechanism with the ram retracted.
Figure 5:
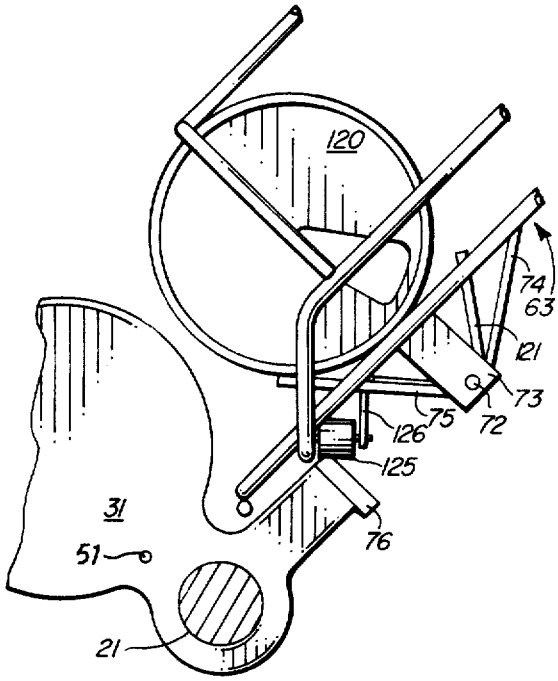
FIG. 5 is a fragmentary end elevation in accordance with FIG. 3, with the ram extended.
Figure 4:
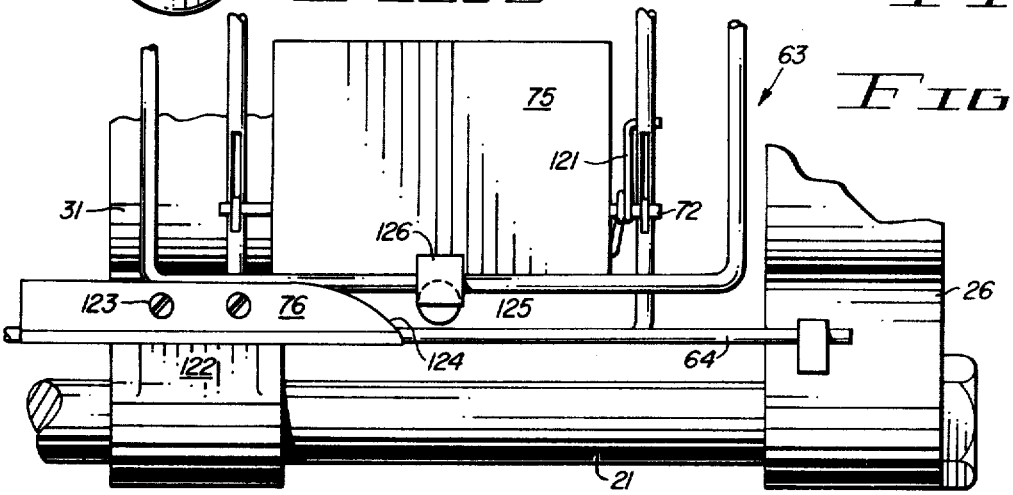
FIG. 4 is a side elevation of the can feed mechanism with the ram retracted.
Figure 6:
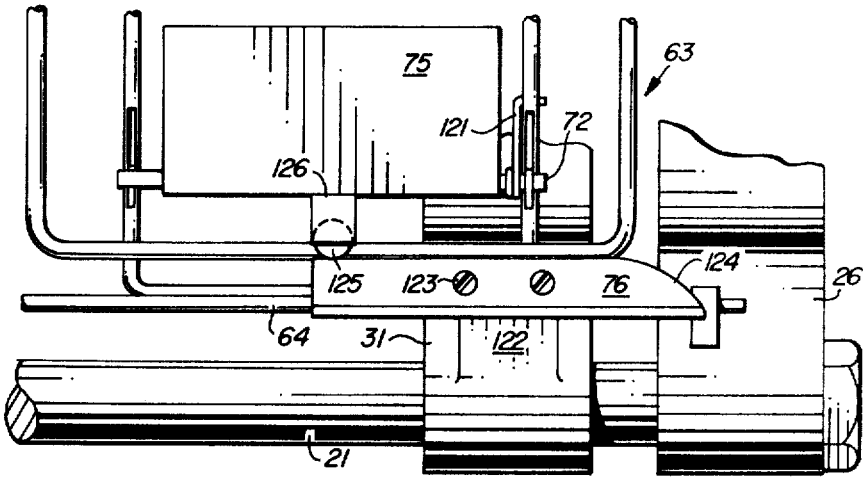
FIG. 6 is a partial side elevation of the can feed mechanism having the ram extended.

Turning now to FIGS. 3 through 6, the operation of the can feed mechanism is more clearly illustrated with the ram in its retracted position in FIGS. 3 and 4 and in its extended position in FIGS. 5 and 6. The ram 31 sliding on the guide rod 21 of FIG. 1 has the can chute 63 mounted as explained in connection with FIG. 1. A can 120 is illustrated on the chute 63 being held by arm 74 in FIGS. 3 and 4 and by arm 75 in FIGS. 5 and 6. Arms 74 and 75 are connected together and are rotatably mounted on the shaft 72 to the bracket 73 and are spring biased with a spring 121. In the position shown in FIGS. 3 and 4, arm 74 stops the line of cans 120 in the chute 63. The linear cam 76 is attached to the sliding ram 31 on a boss 122 with screws 123 and has a cam surface 124. When the sliding ram 31 slides to its extended position, the linear cam 76 engages a cam follower 125 mounted on a bracket 126 to the spring loaded arm 75 to rotate the arm on the shaft 72 against the biasing of the spring 121 to thereby lower arm 74 to allow the can 120 in FIG. 3 to slide down to to the position shown in FIG. 5. When the ram 31 returns to the retracted position in FIGS. 3 and 4, the spring 121 will bias the arm 75 back to its retracted position, thereby allowing the can 120 to drop into the crushing area where it will be supported by the support wires 50 shown in FIG. 1. Thus, with each extension and retraction of the ram 31, an individual can is allowed to move forward with the extended ram and then drop into the crushing area with the retraction of the ram to be crushed on the next stroke of the ram.

Figure 7:
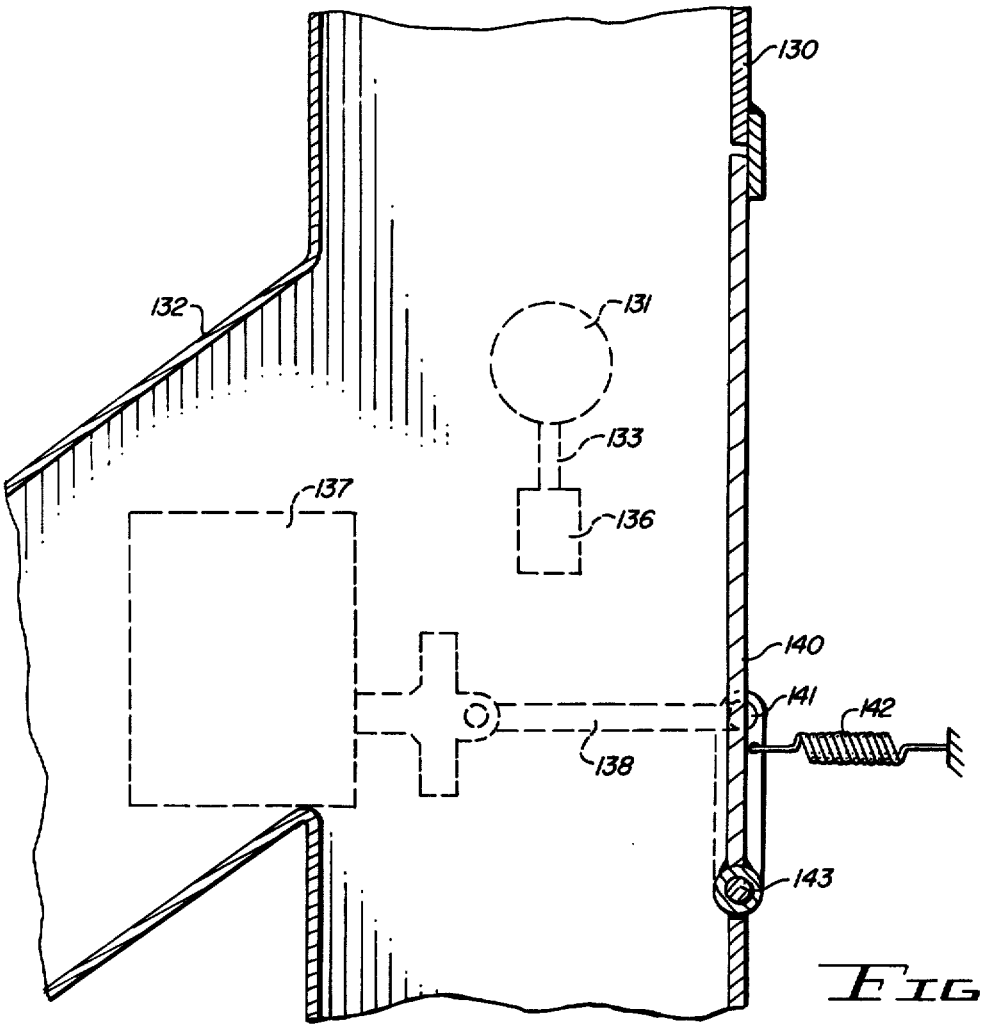
FIG. 7 is a sectional view of a discharge chute for receiving cans discharged from the can crushing mechanism.
Figure 8:
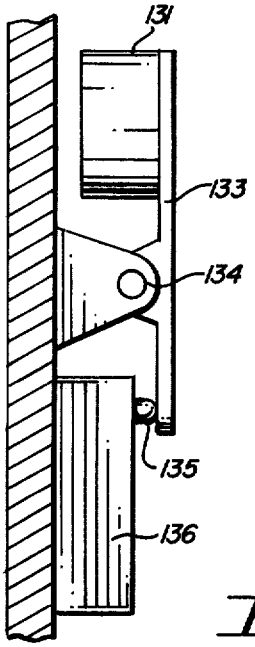
FIG. 8 is a side sectional view of a magnet and switch actuating mechanism for the can sorting mechanism of FIG. 7.

Turning now to FIGS. 7 and 8, a discharge chute 130 is indicated for receiving crushed cans from the can crusher 10. The discharge chute is made of a non-ferrous material, and has a magnet 131 mounted therebeneath, but adjacent the chute and to one side of a side chute 132 connecting to chute 130 for receiving ferrous type cans. The discharge cans are fed in the chute 130 and if a crushed can is ferrous it is captured by the magnet 131, which magnet 131 is connected to a lever arm 133 pivoted on a bracket 134 and must move slightly to capture the ferric can. The movement of the magnet 131 separates contacts 135 of a normally open switch 136. Switch 136 actuates a solenoid 137 mounted below the chute 130 which pulls a linkage 138 connected to a wiper 140 with a pin 141. The wiper 140 is spring loaded with a spring 142 to its normal position, as shown in FIG. 7 and is hinged on a pin 143. Actuation of the solenoid pulls the wiper 140 against the spring 142 to knock a crushed steel can held by the magnet 131 into the side chute 132, whereas aluminum cans continue to slide down the chute 130 without interruption by the magnet 131. Once the steel can is wiped into the side chute 132, the magnet 131 swings slightly on the bracket 134, thereby operating the switch 136 back to its normal open position. This simplified can sorting mechanism allows steel cans to be sorted after they have been crushed, since the can crushing mechanism has sufficient force to crush steel cans, as well as aluminum cans. The chute 130 can be made of aluminum or a non-magnetic stainless steel, or any material desired.

It should be clear at this point that a can crushing machine has been provided which can, with each cycle, crush two or four cans, but it will also be clear that the present invention is not to be construed as limited to the particular forms shown, which are to be considered illustrative rather than restrictive.

I claim:

1. A can crushing mechanism comprising in combination:

a frame;

a plurality of guide rods attached to said frame;

a pair of anvils, each anvil mounted to said guide rods;

a pair of sliding rams slidably mounted to said guide rods;

can support means for supporting a can between each said anvil and one sliding ram;

ram drive means for driving each of said pair of rams sequentially in a timed sequence, said ram drive means being attached to said frame and operatively connected to each said sliding ram; and can feed means for feeding cans between each said anvil and one sliding ram, said can feed means having a chute, a can stop and a reciprocating cam actuated to shift said can stop to release one can at a time, each reciprocating cam being operatively attached to one sliding ram so that each said cam is released in a timed sequence with the movement of each said ram, whereby cans fed to said can crushing mechanism can be alternately crushed by said sliding rams.

2. A can crushing mechanism in accordance with claim 1, in which at least one spring connects said pair of rams to bias each ram away from its associated anvil.

3. A can crushing mechanism in accordance with claim 1, in which said ram drive means is a cam shaped to extend one ram while retracting the other ram of said pair of rams.

4. A can crushing mechanism in accordance with claim 3, in which each sliding ram has a cam follower mounted thereon for riding on said cam.

5. A can crushing mechanism in accordance with claim 4, in which each said cam follower is a roller mounted to the rear of each sliding ram.

6. A can crushing mechanism in accordance with claim 1, in which said can support means is a plurality of supporting wire members attached to said frame and having ends extending toward said anvil, said supporting wire members ends spaced from said anvil to allow a crushed can to pass therebetween.

7. A can crushing mechanism in accordance with claim 6, in which said can support wire members pass through apertures in each said sliding ram.

8. A can crushing mechanism in accordance with claim 1, in which said ram drive means includes a flywheel driving a reduction gear which rotates a ram drive means cam.

9. A can crushing mechanism in accordance with claim 1, in which said cam stop includes two connected arms rotatably mounted to said chute and spring loaded to hold cans in said chute and being rotated by said reciprocating cam on said ram responsive to the movement of said ram.

10. A can crushing mechanism in accordance with claim 9, in which said can stop connected arms shift each can from said first arm to a position between said arms responsive to said reciprocating cam moving said arm and said can is dropped into said can crushing mechanism responsive to said spring returning said arm to rest following said reciprocating cam retracting.

11. A can crushing mechanism in accordance with claim 10, in which one said cam stop arm has a cam follower mounted thereto for engaging said reciprocating cam attached to said sliding ram.

12. A can crushing mechanism in accordance with claim 1, in which each said anvil has an opening formed therein and a spring member mounted at least partially in said opening, whereby crushed cans are pushed loose from said anvils following the can being crushed.

13. A can crushing mechanism in accordance with claim 12, in which each of said pair of sliding rams has an opening formed therein and a spring member mounted at least partially in said opening, whereby a crushed can can be pushed loose from said ram.

14. A can crushing mechanism in accordance with claim 12, in which said opening in each anvil is an elongated slot with a spring member mounted adjacent thereto, whereby crushed cans stuck to said anvil will be pushed away therefrom.

15. A can crushing mechanism comprising in combination: can crushing means for crushing cans with a reciprocating ram;

can feed means attached to said can crushing means for feeding cans thereto one at a time, said can feed means having a can feeding chute for guiding a can to said can crushing means;

a pivoted trip mechanism having a pair of connected trip members mounted to said can feeding rack and extending into the pathway of cans being fed on said rack, one said arm acting as a stop for cans in said rack;

a linear cam member connected to said reciprocating ram for reciprocating therewith;

a cam follower connected to said pivoted trip mechanism for tilting said trip mechanism and stop member to tilt said members to engage a single can for delivery to said can crushing means responsive to the movement of said linear cam member in sequence with said reciprocating ram, whereby one can at a time is fed to said can crushing mechanism.

16. A can crushing mechanism in accordance with claim 15, in which said pivoted trip mechanism trip members includes a first trip member for blocking cans on said chute and a second trip member for holding one can released by said first trip member responsive to said linear cam tilting said first trip member and said second trip member releasing said one can upon the movement of said linear cam, whereby said can can drop into said can crushing means.

17. A can crushing mechanism in accordance with claim 16, in which a spring biases said trip members in one direction against said linear cam, whereby said trip members are rocked by said linear cam in one direction and returned by said spring.

18. A can crushing mechanism in accordance with claim 17, in which said sliding rams have a boss thereon positioned for attaching said linear cam thereto in alignment to strike a cam follower on said trip mechanism.

19. A can crushing mechanism comprising in combination:

can crushing means for crushing cans;

can feed means attached to said can crushing means for feeding cans thereto;

a discharge chute connected to said can crushing means for receiving crushed cans being discharged therefrom, said discharge chute having a main chute for non-ferrous cans and a secondary chute for ferrous cans;

means for directing ferrous cans from said main chute to said secondary chute; and actuation means for actuating said means for directing ferrous cans to said secondary chute, said actuation means including at least one magnet operated switch having a magnet movably mounted to said main chute and operatively connected to said switch, whereby a ferrous can will be captured by said magnet, thereby moving said magnet and actuating said switch.

20. The apparatus in accordance with claim 19, in which a movable wiper is movably connected to said main chute adjacent said secondary chute for pushing ferric cans into said secondary chute when actuated.

21. The apparatus in accordance with claim 20, in which said magnet actuated switch actuates a solenoid connected to said wiper to drive a ferrous can into said secondary chute.

22. The apparatus in accordance with claim 21, in which said wiper is spring loaded to return said wiper to a rest position when said wiper is released by said solenoid.

23. The apparatus in accordance with claim 22, in which said magnet is attached to an arm pivotably attached to said main chute and said pivotable arm have one contact of a switch attached thereto whereby rocking said arm will actuate said switch.

24. The apparatus in accordance with claim 23, in which said magnet attached to said arm is held slightly spaced from said main chute and is drawn against the bottom of said main chute responsive to a ferrous can sliding on said main chute.

* * * * *